United States Patent [19]

Murphy

[11] Patent Number: 4,917,021

[45] Date of Patent: Apr. 17, 1990

[54] DOOR FINGER GUIDE FOR DOORS ON AUTO RACK CARS

[75] Inventor: Michael K. Murphy, Aurora, Ill.

[73] Assignee: Zeftek, Inc., Batavia, Ill.

[21] Appl. No.: 313,628

[22] Filed: Feb. 21, 1989

[51] Int. Cl.[4] ..... B16D 3/02

[52] U.S. Cl. ..... 105/378; 16/90; 16/96 R; 105/225; 160/118; 384/42

[58] Field of Search ..... 105/378, 379, 225; 16/94 R, 95 R, 96 R, 87 R, 9 D; 160/196.1, 118, 119; 384/26, 42

[56] References Cited

U.S. PATENT DOCUMENTS

| | | | |
|---|---|---|---|
| 2,897,515 | 8/1959 | Collins | 160/196.1 X |
| 3,587,477 | 6/1941 | Ferris et al. | 105/378 |
| 4,079,818 | 3/1978 | Chierici | 188/207 |
| 4,114,945 | 9/1978 | Lutz | 384/42 |
| 4,188,888 | 2/1980 | Cooper et al. | 105/199 |
| 4,237,792 | 12/1980 | Somers | 105/199 |
| 4,237,793 | 12/1980 | Holden et al. | 105/225 |
| 4,238,039 | 12/1980 | Cooper et al. | 105/225 |
| 4,239,007 | 12/1980 | Kleykamp et al. | 105/225 |
| 4,249,665 | 2/1981 | Kleykamp | 105/199 |
| 4,261,472 | 4/1981 | Moore et al. | 105/225 |
| 4,264,015 | 4/1981 | Mathieu | 105/225 |
| 4,289,077 | 9/1981 | Kleykamp et al. | 105/199 |
| 4,348,964 | 9/1982 | Randolph | 105/42 |
| 4,437,410 | 3/1984 | Stoller, Sr. et al. | 105/378 |
| 4,440,095 | 4/1984 | Mathieu | 105/225 |
| 4,452,345 | 6/1984 | Mathieu | 188/207 |
| 4,549,771 | 10/1985 | Crossonneau | 384/42 |
| 4,784,068 | 11/1988 | Burke | 105/418 |

FOREIGN PATENT DOCUMENTS

| | | | |
|---|---|---|---|
| 0211017 | 12/1983 | Japan | 384/26 |

*Primary Examiner*—Andres Kashnikow
*Assistant Examiner*—Matthew C. Graham
*Attorney, Agent, or Firm*—Lloyd L. Zickert

[57] ABSTRACT

A door finger guide for doors an auto rack cars to guide the upper ends of the doors along an upper track during opening and closing operations. The door finger guide includes a metal supporting member or base plate having a lower end secured to the door and an upper end in alignment with the upper door track. Plastic bearing means is secured to the upper ends of the door guides which are mounted in opposing relation for coaction with the track. The door guides and plastic bearing portions are diminished so that the tolerance with the track is minimized to reduce vibration in the door and all components associated with the door and located below the guides.

30 Claims, 9 Drawing Sheets

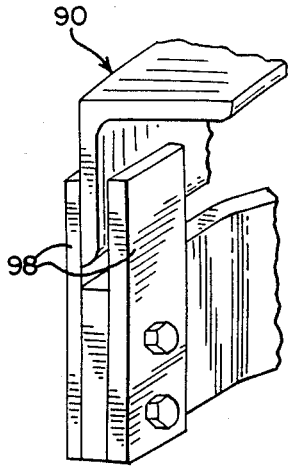
FIG. 15
PRIOR ART
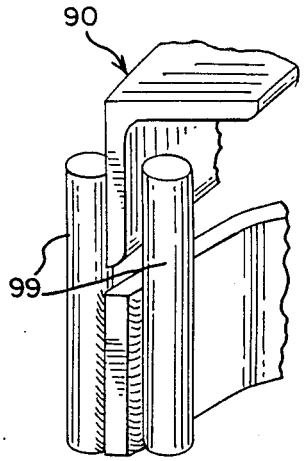
FIG. 16
PRIOR ART
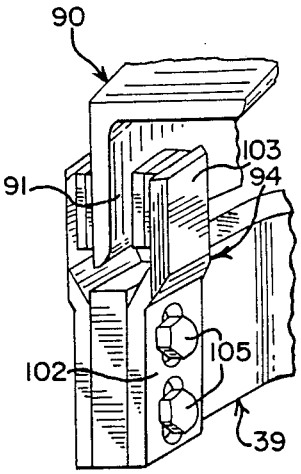
FIG. 17
FIG. 18
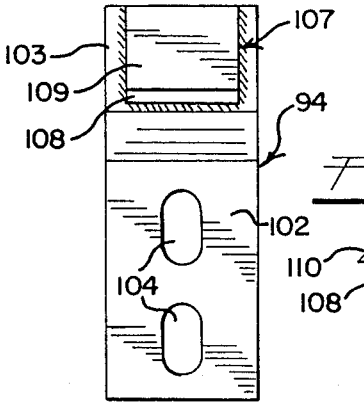
FIG. 19
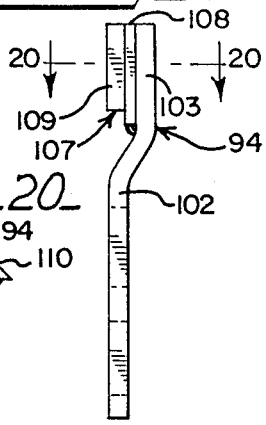
FIG. 20
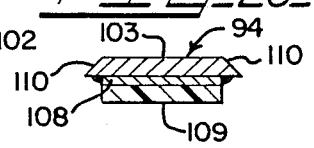
FIG. 21
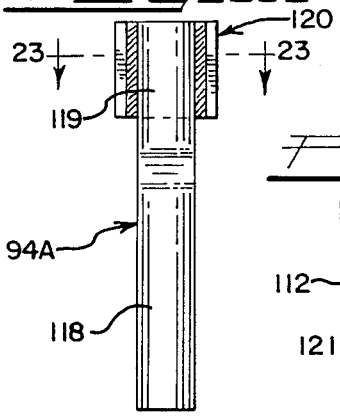
FIG. 22
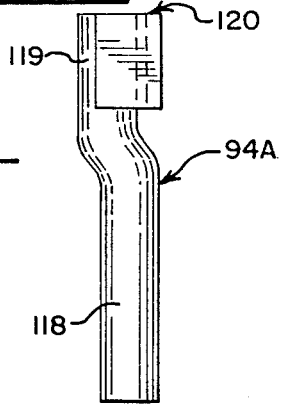
FIG. 23
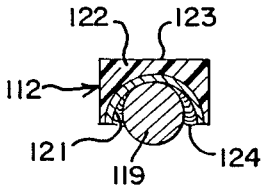

DOOR FINGER GUIDE FOR DOORS ON AUTO RACK CARS

DESCRIPTION

This invention relates in general to an improved door finger guide for doors of auto rack cars, and more particularly to door finger guides mountable near the upper ends of the doors and coacting with the upper door tracks for the doors, and still more particularly to a door finger guide having a bearing means of high-compressive strength, self-lubricating, wear-resistant plastic material to define a plastic bearing engaging the metal door track, and still more particularly to a door finger guide arrangement where the bearing surface of the door finger guides is of a high-compressive strength, self-lubricating, wear-resistant plastic material and dimensioned to reduce the clearance between the guides and the track so as to reduce vibration of the door and its associated components.

BACKGROUND OF THE INVENTION

It has been well known to provide plastic wear members for railway vehicles. For example, U.S. Pat. Nos. 4,188,888; 4,237,792 and 4,289,077 show wear members in the form of liners for center bearings of trucks. Wear members of plastic have also been widely used at the sliding surfaces of coupler members, as disclosed in U.S. Pat. Nos. 4,238,039; 4,249,665; 4,261,472, and 4,264,015. Plastic wear members have further been used for pedestals of a railway truck, as disclosed in U.S. Pat. Nos. 4,237,793 and 4,239,007; and for brake rods, as disclosed in U.S. Pat. Nos. 4,079,818 and 4,452,345. It has also been known to provide wear plates having a plastic material for sliding sill supports, as disclosed in U.S. Pat. Nos. 4,348,964 and 4,784,068.

These wear members have been developed following the availability of suitable plastic resins and particularly certain polyethylenes, such as a linear high-density polyethylene which is usually referred to as an ultra-high molecular weight polyethylene. As disclosed in some of the above patents, these plastic materials have been bonded to metal supporting members which are then mounted on supporting parts of a railway vehicle, or used in sheets and secured in place.

It has only been within the last ten or so years that auto rack cars of the bilevel and trilevel type have included the use of doors at the ends of the cars so as to provide security for the automobiles and vehicles being transported by the rail cars and preventing damage by unauthorized persons. One of the problems encountered with respect to the use of doors has been maintaining the integrity of the door suspension and mounting components to assure proper closing of the doors to maintain the security of the interior of the cars. The suspension system for the doors includes a lower track supporting the doors at the lower ends and guiding them during opening and closing operations, an intermediate arm connected to the doors and the frame of the car, and a guide system at the upper ends of the doors including a track secured to the cars and door finger guides mounted on the doors coacting with the tracks for guiding the upper ends during opening and closing operations. Further, locking devices are used for locking the doors in open and closed positions. Excessive wear of the guides, as well as sometimes complete failure of the guides, results in excessive wear of the other suspension and locking components of the doors, all of which lead to breach of the integrity of the security intended by the doors. Not only are the doors subjected to the normal vibration and oscillations generated by a car during travel over rails, but they are also subjected to the twisting of the entire car structure during car movement, all of which result in a very severe wearing problem for the door finger guides which have heretofore been made of metal such as steel. Also, the tracks are made of steel, as it is necessary to utilize the strength of steel in construction of the components for these cars.

While it is possible to replace the steel door finger guides, it has been found that maintenance is not always conducted at the times where a replacement is first needed. Further, the impact of steel guides on a steel track causes wear of the track and sometimes complete destruction of the track. This impact is transmitted through the other parts of the door components leading to adverse wear conditions of those components.

Thus, the heretofore known metal wear guides have resulted in breaching the integrity of the security of these cars which leads to easy entry of the cars and damage to or loss of the vehicles being transported.

SUMMARY OF THE INVENTION

The improved door finger guide of the present invention not only solves the above problem existing with metal door guides but also produces unexpected materially longer life to other door components, all of which greatly enhance the security feature of the doors against ingress to the cars.

The door finger guide of the present invention includes a plastic bearing of high-compressive strength, self-lubricating, wear-resistant plastic that coacts with the upper metal door tracks to produce greater life for the upper door guide components. The door finger guides are provided in pairs and dimensioned so that the tolerance between the guides and the track is reduced in order to greatly reduce the vibration between the doors and the tracks, thereby greatly enhancing the life of the upper guide system as well as the other door components.

More particularly, the door finger guides include an upper portion with plastic bearing means for aligning with the upper guide track that may be offset from a lower mounting portion. The door finger guides of the invention may be mounted directly to the doors or to an arm or bracket that in turn is secured to the doors so that the finger guides extend from the doors and thereby facilitate coaction with the upper guide tracks.

In order to provide the plastic bearing for the door finger guides, the guides may include a metal plate onto which the plastic pad is bonded and/or molded so that the metal plate can be suitably secured to the supporting member of the door guide. Alternately, the plastic pad may be directly bonded to the metal supporting member or formed to fit with the offset portions of the opposing door guides to provide the proper metal bearing arrangement for engaging the track.

It is therefore an object of the present invention to provide a new and improved door finger guide for use on doors of auto rack cars so as to provide a finger guide of long life and to enhance the life of the track with which it coacts.

Another object of the invention is in the provision of a door finger guide having a lower end for mounting to the door and an upper end offset from the lower end in a direction away from the track but in alignment with the track and a plastic bearing mounted to the upper end for providing a plastic-to-metal engagement that enhances the guiding action of the door and the life of the guides.

Another object of the present invention is in the provision of providing a new and improved door finger guide having an offset portion with a plastic bearing for alignment with the upper door track of an auto rack car and which is dimensioned so as to minimize the tolerance with the track to reduce vibration and oscillations in the door and components associated with the door located below the guides to thereby greatly increase the life of the guides and the door components so as to maintain longer integrity between the door and car.

Another object of the present invention is to provide an improved door finger guide to materially reduce the coefficient of friction between the door finger guides and the tracks as opposed to heretofore used metal guides so as to reduce the effort needed to open and close the door, and to reduce the wear between the guides and the tracks so as to maintain the integrity of the support for the door at the upper end and not compromise the intended security function of the door, and to further reduce the maintenance requirements for the other supporting, guiding and locking components of the door which reduces the overall maintenance requirements.

A still further object of the door finger guide of the invention is to maintain the integrity of the support for the upper end of the door, thereby improving the safety of the personnel operating the door.

Other objects, features and advantages of the invention will be apparent from the following detailed disclosure, taken in conjunction with the accompanying sheets of drawings, wherein like reference numerals refer to like parts.

DESCRIPTION OF THE DRAWINGS

FIG. 15 is an enlarged fragmentary perspective view of door finger guides of the prior art;

FIG. 16 is a view like FIG. 15 showing a still further type of prior art door finger guide;

FIG. 17 is a view like FIGS. 15 and 16 and showing one form of the door finger guide of the present invention as they relate to an upper track;

FIG. 18 is an elevational view taken from the inside of a door finger guide according to the present invention and the embodiment of FIG. 17;

FIG. 19 is an end elevational view of the door finger guide of FIG. 18;

FIG. 20 is a transverse sectional view taken substantially along line 20—20 of FIG. 19;

FIG. 21 is a vertical elevational view of a modified door finger guide according to the present invention where the supporting member is in the form of a cylindrical bar;

FIG. 22 is a side elevational view of the door finger guide of FIG. 21;

FIG. 23 is a transverse sectional view taken substantially along line 23—23 of FIG. 21;

DESCRIPTION OF THE INVENTION

Figure 1:
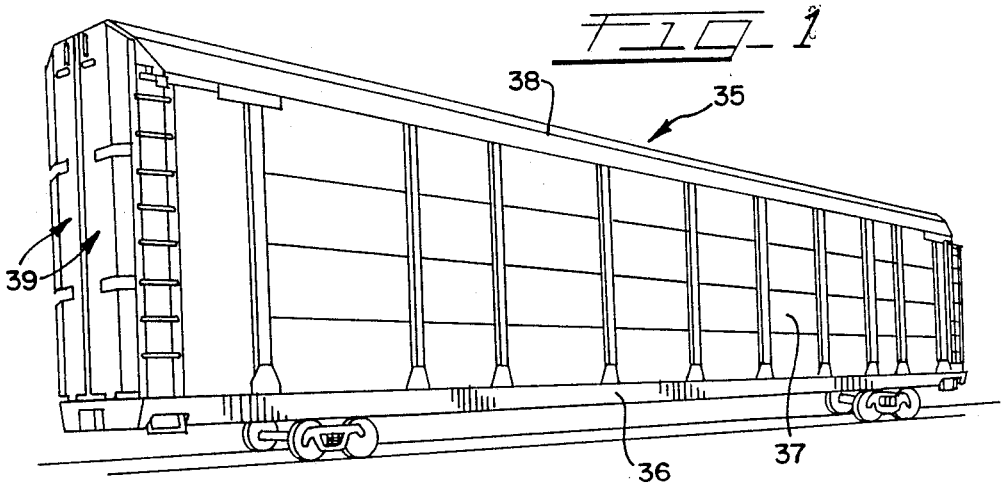
FIG. 1 is a perspective vie of an auto rack car having doors at the ends which use door finger guides at the upper ends of the doors for supporting the doors in an upright position and for guiding the doors during opening and closing operation.

The door finger guide of the present invention solves a severe wear problem experienced in door-mounting hardware for clamshell doors closing the opposite ends of auto rack cars. Clamshell doors have been used on auto rack cars for at least eleven years and the problems of wear have been a major concern to the railway industry.

An auto rack car may be of the two-level or three-level type. A typical three-level car would be about 89 feet long and stand about 16 feet high. The clamshell doors are intended to close the openings at opposite ends of the car so that a person cannot enter the interior of the car. Thus, the doors, when properly mounted and when properly functioning, would maintain the integrity of the security of the car to prevent pilferage and/or vandalism of the vehicles being transported.

Mounting hardware for the doors includes a lower track on which rollers carried by the door are supported, locking mechanisms at top and bottom levels or decks, pivotally mounted arms intermediate at the upper levels or decks, and door finger guides near the upper ends of the doors coacting with tracks mounted on the car.

A certification rule followed in the railway industry requires repair or replacement of any parts experiencing 25 percent wear. Periodic inspections are made. Wear between the inspections may vary.

It has been found that the heretofore used metal door finger guides have sometimes worn so severely within a few months' usage of a car that a guide may even be missing or the track may be worn beyond effective use. It has also been found that other door mounting components have resulted in severe wear which has been somewhat attributed to the undue wear or failure of the door finger guides. These guides not only guide movement of the doors between open and closed positions but also function to support the doors in vertical position when they are closed.

Because of track irregularities, it has been necessary to provide sufficient tolerance when using metal door finger guides to avoid interference with door operation. Because of the vibration experienced throughout a car door during movement along tracks, the amount of tolerance has a direct relation to the vibration of the doors. Thus, reduction of tolerance would favorably affect the vibration component.

With respect to wear experienced on railway cars where steel against steel is involved as wear takes place, the tolerance between the steel parts rapidly increases. This is particularly true in connection with steel finger guides that engage a steel track. As the tolerance increases, the ensuing damage throughout the door-mounting hardware components is dramatically increased.

The door finger guide of the present invention includes a fixed pad of high-compressive strength, self-lubricating, wear-resistant plastic material having a low coefficient of friction against steel and therefore reduces the friction between the guides and the steel tracks. This reduces the effort needed to open and close the doors, and by virtue of having a plastic material coacting with the steel track, some damping effect is produced between the track and the guides during vibration of the cars. Because of the give in the plastic material, a closer tolerance can be used between the plastic pads of the door finger guides and the steel track which reduces the overall vibration of the door. The low coefficient of friction between the guides and the track reduces the wear of the guides and the tracks so as to favorably maintain the integrity of the support of the door at the upper end and to favorably affect the integrity of the door system to prevent entry into the car and to maintain security of the contents. That the integrity of the support of the doors at the upper end is maintained also enhances the safety of personnel operating the doors. Since vibration is reduced, the other door-mounting hardware will wear much longer. Finally, the overall maintenance of the doors and mounting hardware is materially reduced. The improved door finger guide of the present invention reduces the tolerance between the guides and the track by 25 to 50 percent, thereby reducing the level of vibration accordingly.

Figure 2:
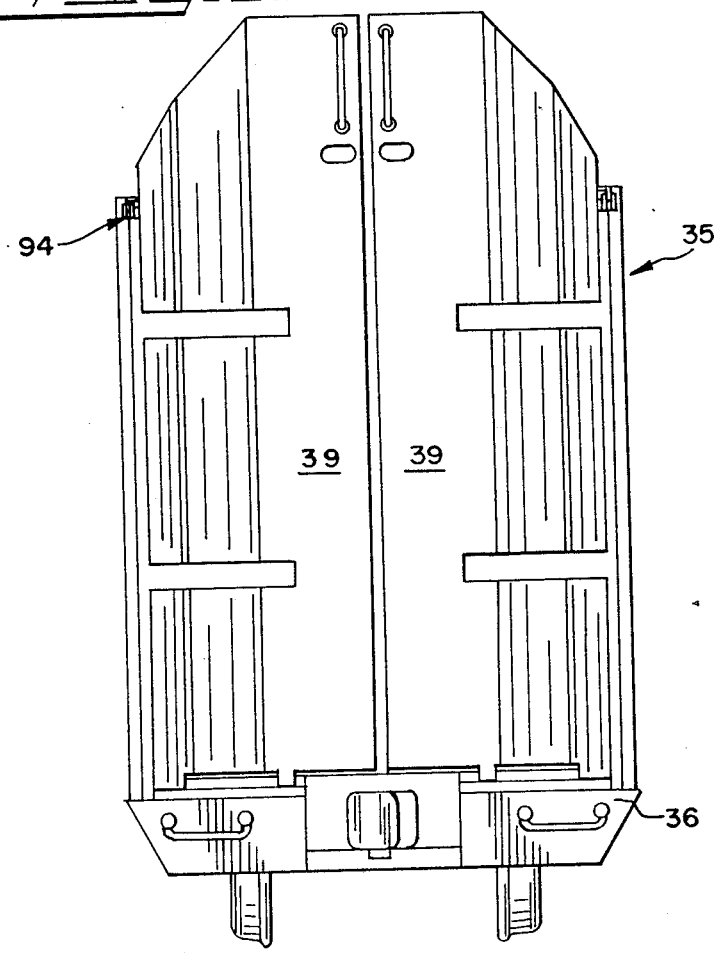
FIG. 2 is an end elevation view of an auto rack car showing the doors and the door finger guides according to the present invention.
Figure 14:
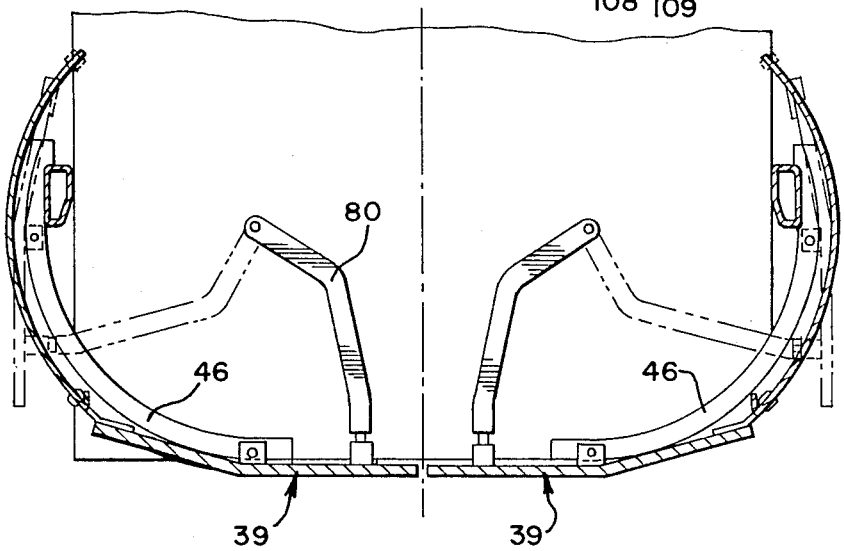
FIG. 14 is a somewhat schematic plan view of the door support mechanism for the doors and illustrating the doors in solid in closed position and in phantom in open position.

A typical three-level auto rack car is illustrated in the drawings to illustrate the application of the present invention. This car, generally designated by the numeral 35, as seen in FIGS. 1 and 2, includes a car frame 36 supporting upwardly extending side walls 37 and a roof 38. The opposite ends of the car are used to load and unload vehicles on the various levels and are closed by a pair of coacting clamshell doors 39 that stand in an upright position. The doors are supported at their lower end on rails connected to the car frame and are supported at the upper end by door finger guides coacting with upper tracks. The doors are shown in closed position in FIGS. 1 and 2 and in closed position in solid lines in FIG. 14 and in open position in dotted lines in FIG. 14.

Figure 3:
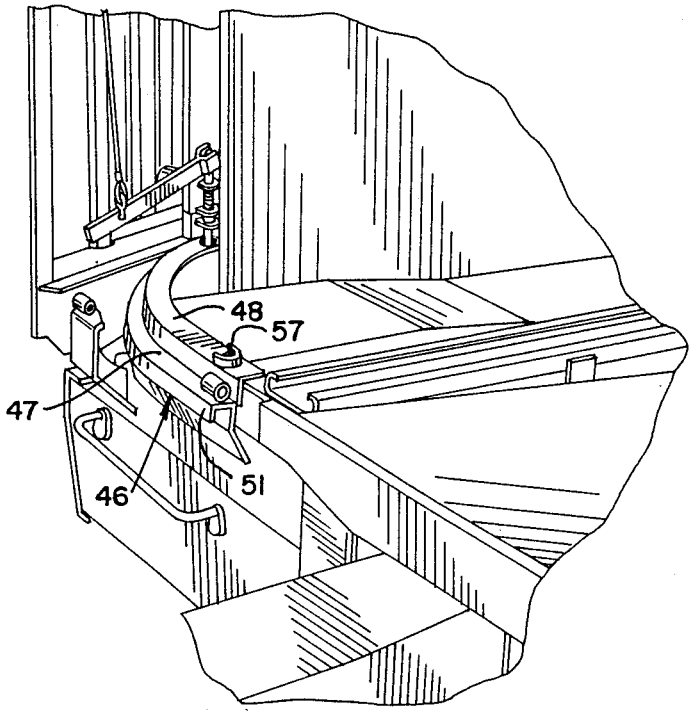
FIG. 3 is a fragmentary perspective view of the end of a car showing the door locking mechanism at the lower end of the door when the door is locked in open position.
Figure 4:
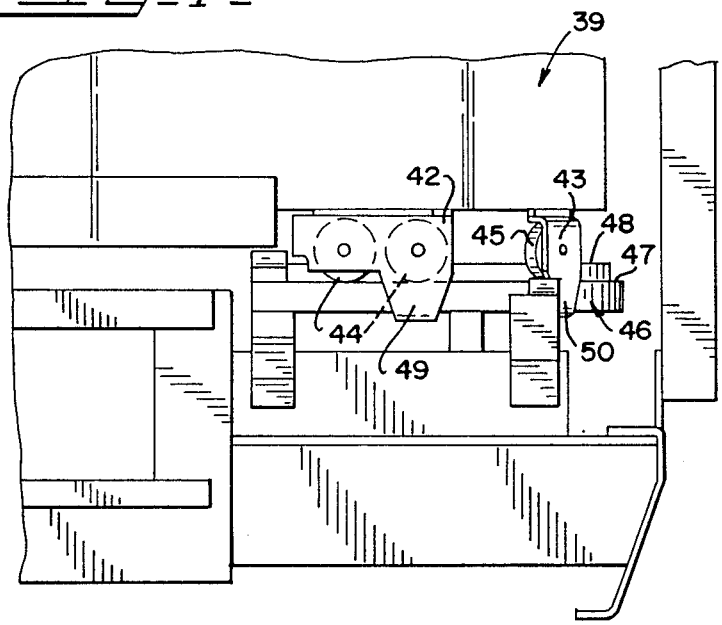
FIG. 4 is a fragmentary elevational view at the lower end of a door showing the mounting arrangement for the lower end of the door on a supporting rail.
Figure 5:
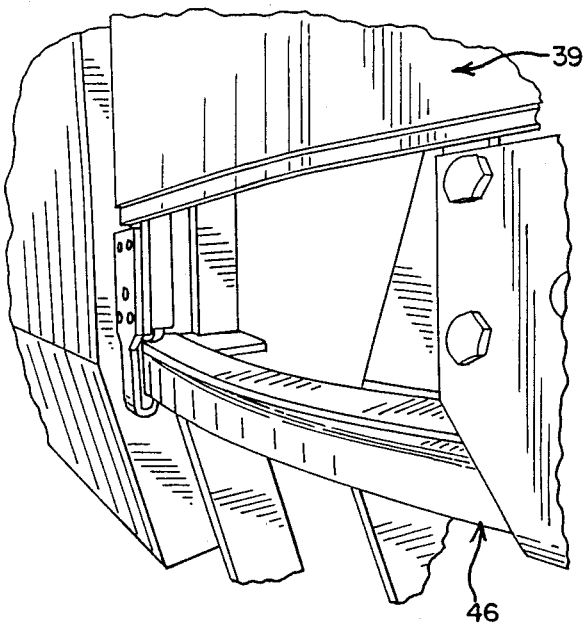
FIG. 5 is another fragmentary view of the lower end of a door to show the mounting arrangement of the door relative to the lower track.
Figure 6:
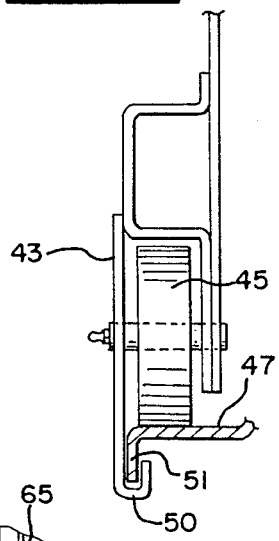
FIG. 6 is a cross-sectional view taken through the lower track and illustrating the roller and J-hook at the bottom of a door and how they coact with the lower rail on a car.

As seen particularly in FIGS. 3, 4 and 5, brackets 42 and 43 are mounted at the lower ends of the doors 39 and which brackets in turn rotatably mount rollers 44 and 45 that are rollingly supported on a lower rail or track 46. Only one of the rails is shown, but it will be appreciated that a like rail will be at the other side of the car for supporting the other door. The rail 46 includes a horizontally disposed bearing surface 47 on which the rollers engage and a somewhat offset and higher horizontally disposed surface 48 for coacting with a locking pin to provide a locking system at the lower end of the door. The lower end of the brackets 42 and 43 are formed with a J-hook 49 and 50 respectively for coacting with a flange or lip 51 extending downwardly from the roller bearing surface 47 of the rail 46 to guide the movement of the lower part of the doors and maintain the rollers on the rail.

Figure 7:
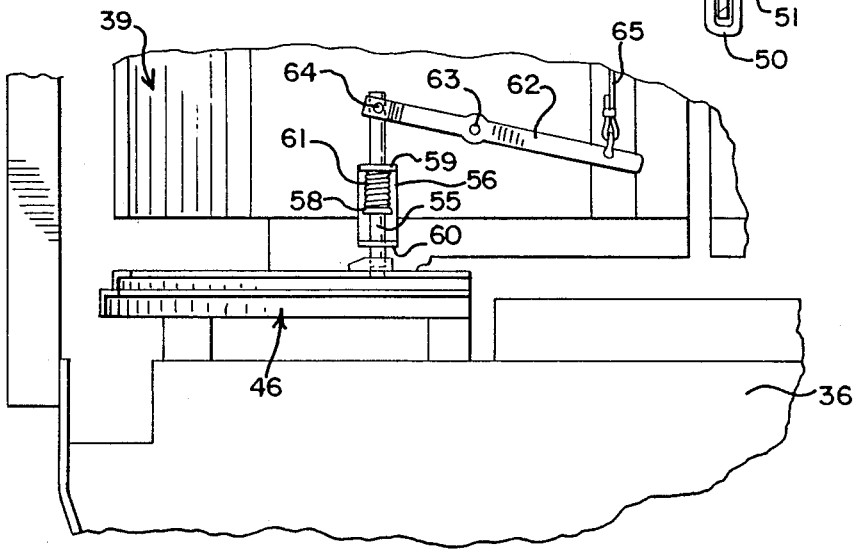
FIG. 7 is a fragmentary elevational view taken from the inside of a car to illustrate the locking pin mechanism at the lower end of a door when the door is locked in closed position.

A locking mechanism is preferably provided at the top and bottom levels of the car and interconnected so that they will operate together when functioning to lock and unlock the doors. As seen particularly in FIGS. 3 and 7, the locking mechanism at the lower ends of the doors includes a vertically disposed pin 55 mounted by vertical movement in a bracket 56 secured to the door and coacting with pin holes on the locking step 48 of the rail. As seen in FIG. 3, a pin hole 57 is provided at the inner end of the rail 46 for receiving and coacting with the pin when the door moves to closed position to lock the door in closed position. Likewise, a pin hole is provided along the rail for locking the door in open position. A collar 58 is provided on the pin and is disposed between upper and lower ears 59 and 60 of the bracket 56 for bottoming at one end of a spring 61 which is bottomed at the other end at the ear 59 to normally urge the locking pin downwardly so that it will fall into locking position at either the closed or open position of the door. In order to operate the locking pin, an actuating lever 62 is pivotally mounted on the door at 63 and pivotally mounted on the top end of the pin 55 at 64 whereby a force is applied. It will be appreciated that raising of the pin 55 will be accomplished by applying a downward force on the outer free end of the arm 62 which is connected to upper locking system by a cable 65 so that the upper system is likewise actuated at the same time to unlock the door and allow it to be moved either from closed position to open position or from open position to closed position. The door 39 is shown in closed position in FIG. 4 and in open position in FIG. 5.

Figure 10:
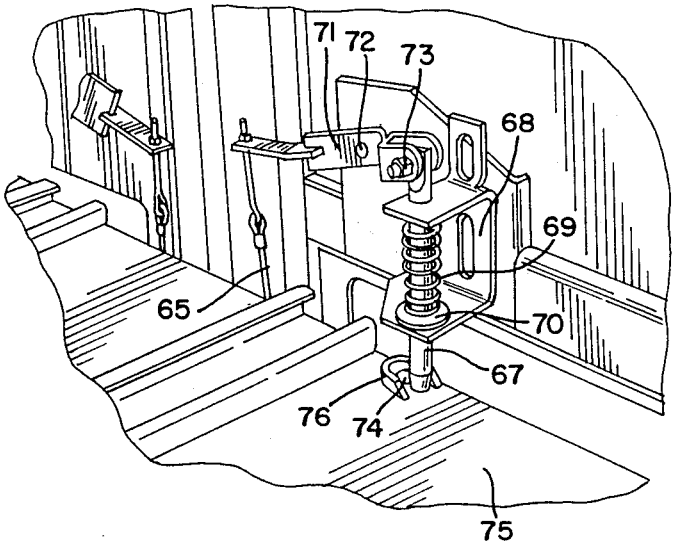
FIG. 10 is an inside fragmentary perspective view of an intermediate part of the doors showing the locking pin and how it operates with an intermediate lever of the car.

An example of an upper locking mechanism is illustrated in FIG. 10 wherein a lock pin 67 is mounted in spaced ears of a bracket 68 carried on the door. A spring 69 bottoming on a collar 70 secured to the pin and the upper ear continually urges the pin downwardly. An actuating lever 71 pivoted to the car door at 72 and to the upper end of the pin at 73 when pulled down at its outer free end will cause the pin to move upwardly. Release of a force on the actuating lever will allow the spring to force the pin 67 downwardly so that it can sit in a pin socket or hole when the pin aligns with the hole. The cable 65 is secured to the outer free end of the actuating lever 71 and any intermediate locking system so that all pins on one door are actuated at the same time. As seen particularly in FIG. 10, a pin hole or socket 74 is provided in the floor 75 for coacting with the pin in closed position. Likewise, a pin hole would be provided in the floor for locking the door in open position. Additionally, a stop 76 is associated with each pin hole in order to assist in stopping the door when it reaches the closed position. The lower end of the pin is beveled to facilitate entry of the pin into the pin hole.

Figure 8:
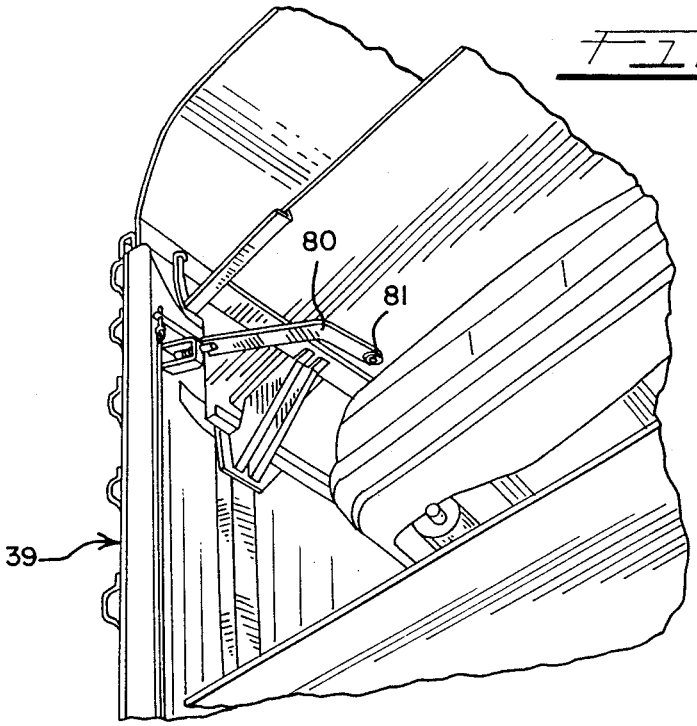
FIG. 8 is a fragmentary perspective view taken at an intermediate position of the door with the door in partially open position and showing the mounting arm for providing guiding support to the intermediate part of the door.
Figure 9:
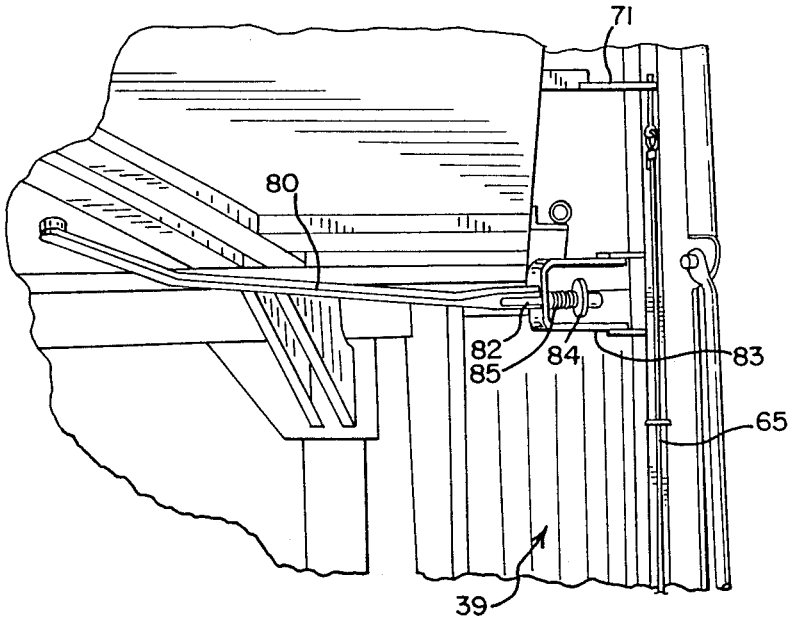
FIG. 9 is a fragmentary perspective view of the supporting arm shown in FIG. 8 and also showing a part of the cable mechanism for the upper lock unit of the door.

The doors are further guided between open and closed positions by one or more arms 80 pivotally connected to the car frame and resiliently connected to the door. As seen particularly in FIGS. 8, 9 and 14, the guide arms may be pivotally connected at one end at 81 to the underside of a floor at one of the levers and connected at the other end to a pin 82 freely received in a guide hole of a bracket 83. A collar 84 is fixed to the pin 82 and against which a spring 85 bottoms on one end. The other end of the spring bottoms on the side of the bracket 83. So, with the bracket 83 mounted to the door, the inner action of the pin 82 on the end of the guide arm 80 provides a resilient connection between the guide arm and the door. It will be appreciated that any number of guide arms may be provided for each of the doors, but generally only one will be provided for each door at the upper level.

For supporting and guiding the upper ends of the doors, an upper rail or track 90 suitably secured to the car frame or body coacts with door finger guides mounted on the doors. The track 90 includes a vertically extending and longitudinally arcuately formed track member 91 along which door finger guides 94 that are mounted in pairs slidably engage.

Heretofore, the door finger guides were in the form of flat steel bars 98, as seen in FIG. 15, or round steel bars 99, as shown in FIG. 16, which coacted with the steel track 90. The steel-against-steel engagement caused rapid wear. The door finger guides of the present invention produce a plastic-to-steel engagement which not only materially reduces the coefficient of friction between the track and the door finger guides but also allows the reduction of the tolerance between the guides and the track. For comparison purposes, one form of door finger guide according to the present invention and identified by the numeral 94 is illustrated in FIGS. 17 to 20.

Guide 94 is in the form of a flat steel bar having a lower mounting end 102 and an upper wear pad end 103. The lower end 102 includes bolt slots 104 for facilitating the mounting of the guide to a door with bolts, such as bolts 105 shown in FIG. 17, whereby the guides may be adjusted vertically. It is preferred thereafter to tack weld the lower mounting end 102 to the door or to a supporting arm to which the guide is to be attached. The upper end 103 is offset from the lower end 102 away from the track 91 so as to accommodate the wear pad. A wear pad 107 is mounted to the side of the upper end 103 which includes a steel base plate 108 having a pad of high compressive strength, self-lubricating, wear-resistant plastic material 109.

Figure 13:
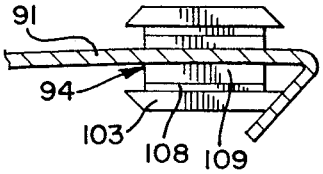
FIG. 13 is a transverse sectional view taken substantially along line 13—13 of FIG. 12 to illustrate the coaction of a door finger guide with an end stop

The plastic pad 109 is suitably secured to the base plate 108. Preferably the pad is molded and bonded to the base plate in a suitable manner so as to reliably connect the plastic to the base plate. The plastic pad and base plate are made as an integral unit and which is then thereafter suitably attached to the flat bar and preferably welded to the bar so that the wear pad and the supporting member will constitute an integral unit. The sides of the wear pad 107 will be such as to provide the desired wear-resistant surface for engagement with the upper track 91. The vertical edges of the upper end 103 are beveled at 110 for purposes of providing sufficient clearance with end stops at opposite ends of the track 90, as seen particularly in FIG. 13. This feature minimizes the wear between the guide and the end stops.

Figure 12:
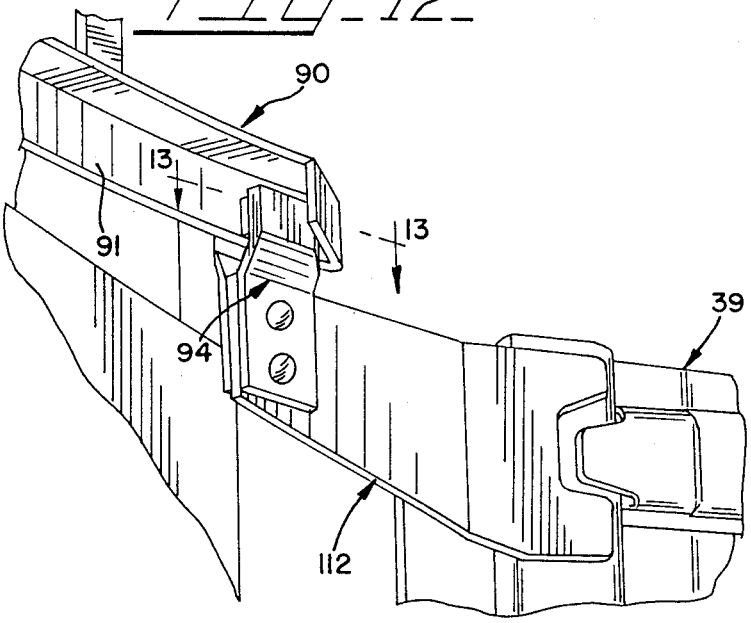
FIG. 12 is a fragmentary perspective view and enlarged to illustrate the position of the door finger guides when the door is in fully closed position.

While the holes 104 in the guide 94 are slotted, they may be round where there is no need for adjustment or for where the guides are attached to a part of the door by rivets, such as illustrated in FIG. 12.

It will be appreciated that the door guides are provided in pairs for coacting with the upper track, as illustrated in FIG. 17, so that a plastic pad is disposed between the steel track 91 and the door. As already mentioned, the plastic pad, by virtue of its low coefficient of friction with steel, can be spaced closer to the rail than a metal guide so that the tolerance is appreciably reduced to thereby reduce the vibration of the door. At the same time, because the plastic pad has some give, it can easily work past any irregularities in the track that may be caused by wear or otherwise as the door moves between open and closed positions.

While the upper ends 103 of the guide 94 are offset from the lower ends in order to make room for the wear pad 107, it can be appreciated that the bar may be straight and then shimmed to space it from the door so that the thickness of the wear pads can be accommodated. Further, it can be appreciated that the center of the wear pad may have a hole for welding the wear pad to the supporting member or for allowing it to be bolted to the supporting member.

It will now be appreciated that the door finger guide 94 will come as an assembly where two guides will be used as a pair for a door to coact with a track.

Figure 11:
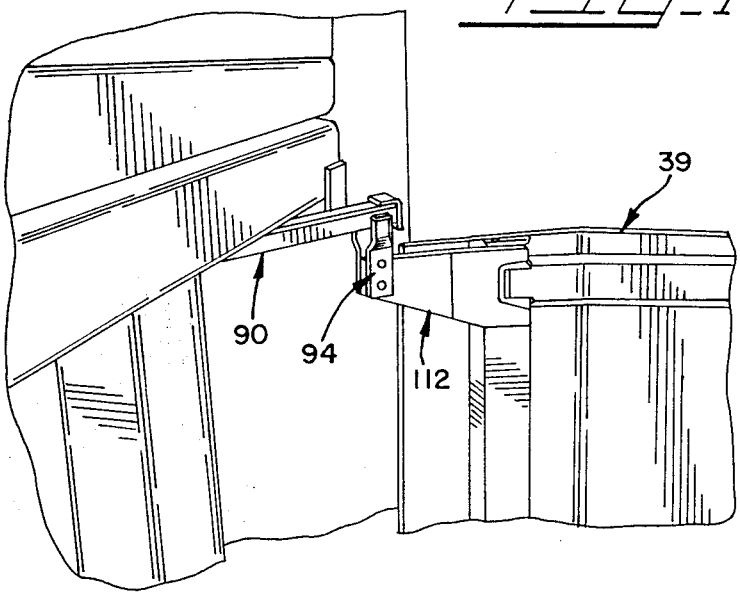
FIG. 11 is an inside fragmentary perspective view showing the door finger guides at the upper end of a door mounted on an extension arm and in coacting relation with the upper guide rail.
Figure 24:
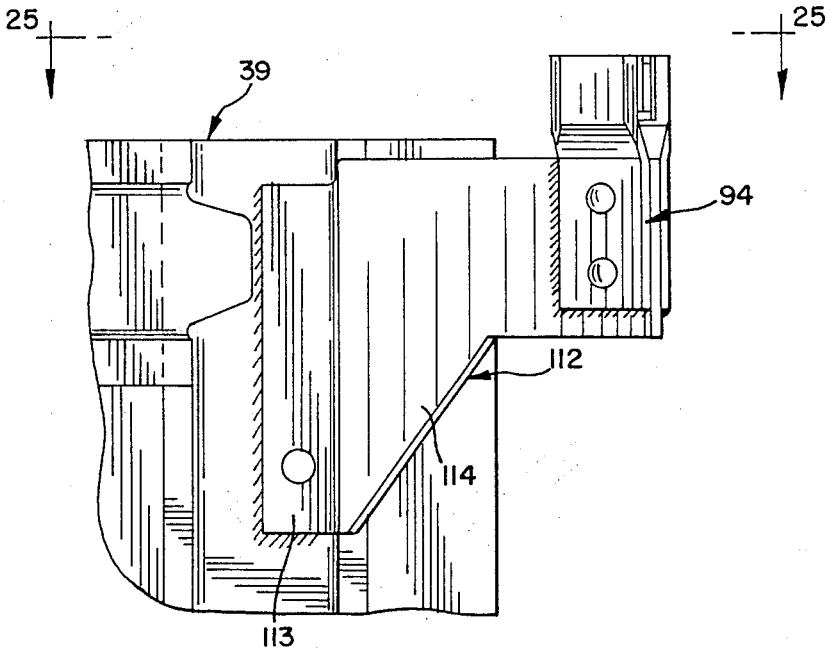
FIG. 24 is a fragmentary view of the upper part of a door and showing a door finger guide assembly including door finger guides and an extension arm that is mounted to the door.
Figure 25:
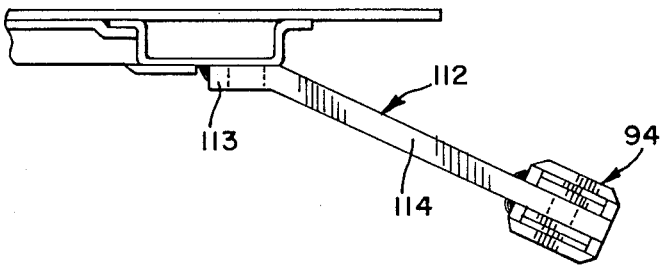
FIG. 25 is a top plan view looking along line 25—25 of FIG. 24.

The finger guides may be connected directly to the door or to an extension arm that is in turn connected to the door, as illustrated in general in FIGS. 11 and 12 and in more detail in FIGS. 24 and 25. The extension arm, generally indicated by the numeral 112, is fitted at its outer free end with a pair of door finger guides 94 and then suitably secured at its inner end to the door 39 by bolts, welding, or otherwise. It should also be appreciated that the door finger guides may be bolted, hucked, riveted, or welded in place on an extension arm 112 or directly to the door. The extension arm includes at its inner end a mounting plate portion 113 that is suitably mounted to the door on a channel or other part of the door and a main body portion 114 that is angularly disposed to the mounting plate portion 113, as particularly seen in FIG. 25, in order to properly dispose the door finger guides 94 in relation to the upper track. As seen in FIG. 24, the door guides 94 are riveted and welded to the extension arm 112, while the extension arm 112 is welded to the door. Where desired, the extension arm and door finger guides can come as an assembly and be provided to the purchaser for direct mounting on original equipment or used equipment.

Preferably, the plastic pads 109 are simultaneously molded and bonded to the base plate 108 which has been prepared in a suitable manner prior to molding for enhancing the bonding function.

While any suitable plastic material having a low coefficient of friction to steel, a high compressive strength and a high resistance to wear may be used, it will be appreciated that the plastic material preferably will be a linear high-density polyethylene which is usually referred to as an ultra-high molecular weight polyethylene. One such acceptable polymer material is defined as "1900 UMHW polymer" and available from Himont U.S.A. This material has a molecular weight greater than 3.5 million. It is also preferable that the plastic be black in color, as black has the highest resistance to ultra-violet and also because black has the most suitable coefficient of thermal conductivity which reduces cycle time during the manufacturing process that requires heat and pressure. However, the plastic may be of any color desired and may be of other types such as nylon and the like. This plastic resin is also dry self-lubricating so as to minimize wear on any surface it engages.

It may be appreciated that the supporting member for the wear pad may take the form of a round bar, as illustrated in the embodiment of FIGS. 21 to 23. This door finger guide, generally designated as 94A, includes a length of round bar having a lower end portion 118 and an upper end portion 119 and a wear pad 120 suitably secured to the upper end portion 119. The upper end portion is offset from the lower end portion to accommodate the thickness of the wear pad when fitting the guide to a door. The wear pad 120 includes a curvate steel base plate 121 having bonded thereto a plastic pad 122 having a substantially flat bearing surface 123 which would engage against the track 91. The base plate 121 of the wear pad is preferably welded to the upper end of the supporting member at 124. Door finger guide 94A may be suitably attached to a door or an extension arm such as by welding or otherwise. The operation of guide 94A will be the same as the operation of guide 94 and the same advantages will be produced over using a steel door finger guide.

Figure 26:
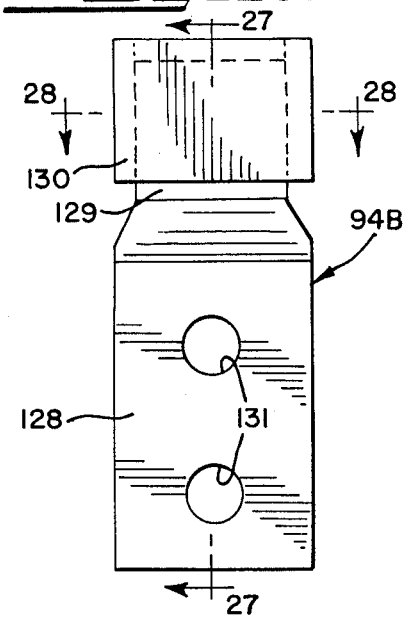
FIG. 26 is an elevational view of a further modified door finger guide according to the present invention where the plastic pad is bonded directly to the supporting bar.
Figure 27:
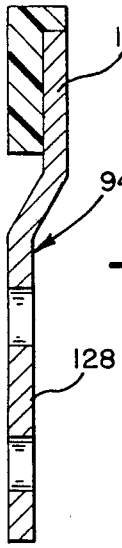
FIG. 27 is a vertical sectional view taken through the guide of FIG. 26 and substantially along line 27—27 thereof.
Figure 28:
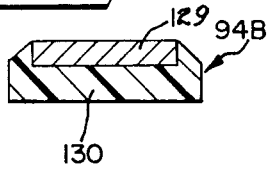
FIG. 28 is a transverse sectional view taken substantially along line 28—28 of FIG. 26.

A further embodiment of the invention is shown in FIGS. 26, 27 and 28, wherein the door finger guide is generally designated by the numeral 94B and includes a steel supporting member having a lower mounting end 128 for mounting the guide to a door or an extension arm and an upper wear pad end 129 having a plastic pad 130 simultaneously molded and bonded directly to the upper end 129. It will be further noted that the plastic pad 130 is formed to overlap the side and top edges of the upper end 129. Optionally, the plastic pad may be just provided on the surface of the upper end facing the track or on the surface together with the side edges or on the surface together with the side edges and top edge. The upper end 129 is offset from the lower end 128 for purposes of accommodating the thickness of the plastic pad, and it will be appreciated that the dimensions will be such as to minimize the tolerance with the steel guide rail so as to minimize the vibration of the door. Holes 131 are provided in the lower end 128 in order to facilitate mounting of the door finger guide to a door or an extension arm. While the holes are shown to be round, they could be slotted. If desired, the holes could even be omitted.

Figure 29:
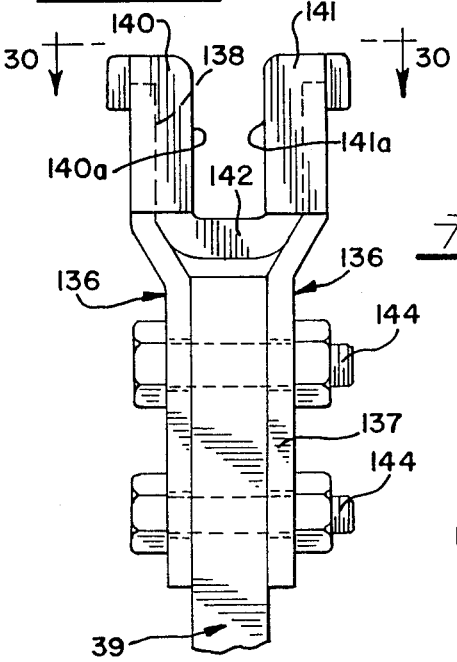
FIG. 29 is a vertical end elevational view of a still further modification of the present invention showing a molded plastic pad for application to a pair of door finger guide support members.
Figure 30:
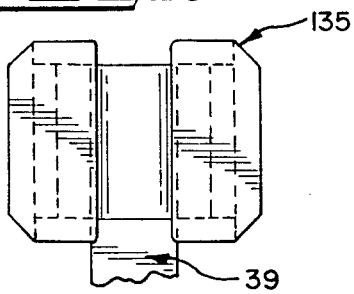
FIG. 30 is a top plan view of the embodiment of FIG. 29 looking along line 30—30 thereof.
Figure 31:
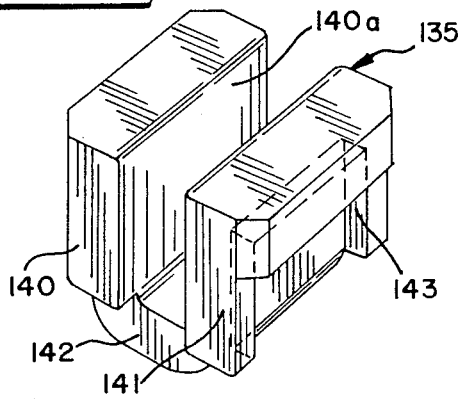
FIG. 31 is a perspective view of the embodiment of FIGS. 29 and 30 looking from above.

Another embodiment of the invention is disclosed in FIGS. 29, 30 and 31, which differs from the other embodiments in that the plastic wear pad is not bonded to the supporting members. Additionally, this embodiment is in the form of a plastic insert or bearing which is mounted on a pair of preformed supporting members. More specifically, this embodiment includes a molded plastic bearing member 135 formed to be mounted on a pair of steel supporting members 136 that are secured to the door 39. Each of the steel supporting members 136 includes a lower mounting end 137 for mounting the supporting members to a door and an upper bearing receiving end 138 onto which the plastic bearing 135 is mounted. The upper bearing receiving ends are offset from the lower ends 137 away from the track so as to provide ample room for receiving the plastic bearing 135.

Bearing 135 is U-shaped and includes upstanding opposed wear pads 140 and 141 interconnected by a bight portion 142. The upper wear pad portions 140 and 141 are provided with sockets 143 at their outer sides for receiving the bearing receiving ends 138. Accordingly, once the bearing 135 is mounted on the upper ends of the supporting members 136, they provide substantially flat opposed bearing surfaces **140*a* and 141*a* between which the track is received. The steel supporting members 136 may be suitably secured to the door 39 such as by nut and bolt units 144** or other fasteners. Once the plastic bearing is in mounted position on the steel supporting members, and the door guide assembly is placed in association with a track, the bearing will stay in place and not be dislodged from the supporting members. If desired, any suitable fastening means could be used to additionally fasten the plastic bearing to the supporting members. It will be appreciated that this embodiment will produce the same advantages as the previous embodiments.

The door finger guides of the invention coact with the upper tracks to further support the doors in upright position when they are closed, together with the pivot arms and locking mechanisms, and guide the upper ends of the doors together with the pivot arms during opening and closing operations. By reducing the tolerance between the door finger guides and tracks, the doors are more firmly supported at their upper ends to reduce movement between the guides and tracks and reduce ultimate vibration to the door and all door hardware below the guides, thereby greatly enhancing the life of all hardware.

It will be understood that modifications and variations may be effected without departing from the scope of the novel concepts of the present invention, but it is understood that this application is to be limited only by the scope of the appended claims.

The invention is hereby claimed as follows:

1. A door finger guide for a door on an auto rack car, said door finger guide adapted to be mounted adjacent the upper end of the door in opposing relation to a second guide to coact with and guide the upper end of the door along a metal track fixed to the car during opening and closing of said door, each guide including a metal supporting member having a lower end adapted to be mounted on the door and an upper end aligned with the track, said upper end being offset from the lower end in a direction away from the track, wear pad means secured to the upper ends of said guides including a plastic bearing for engagement with said track, said plastic bearing being of a high compressive strength, self-lubricating, wear-resistant plastic material, and said plastic bearings being dimensioned to provide a relatively close fit with the track in order to minimize the tolerance with said track and thereby reduce vibration in the door and associated components located beneath the guides.

2. The guide of claim 1, wherein said wear pad means includes a metal plate secured to the supporting member and said plastic bearing is bonded to said plate.

3. The guide of claim 2, wherein said plastic bearing is molded to said plate.

4. The guide of claim 2, wherein said supporting member is flat and said plastic bearing is flat.

5. The guide of claim 2, wherein said upper end of said supporting member is curvate in cross section and said metal plate is curvate to matingly fit said upper end, and said plastic bearing is formed to provide a substantially flat bearing surface for engagement with said track.

6. The guide of claim 1, wherein said plastic bearing is in the form of a pad of plastic directly bonded to said supporting member.

7. The guide of claim 6, wherein said pad of plastic extends over the surface of the supporting member facing said track.

8. The guide of claim 7, wherein said pad of plastic also extends over the opposed vertical edges of said supporting member.

9. The guide of claim 8, wherein said pad of plastic also extends over the top edge of said supporting member.

10. The guide of claim 1, wherein the side edges of said supporting member are beveled to eliminate interference with car parts when the door is in the fully open and fully closed positions.

11. The guide of claim 1, wherein said plastic bearing is U-shaped to fit over the upper ends of said guides and define opposed bearing surfaces for said track.

12. The guide of claim 1, wherein said guides are in combination with an extension arm secured to the door so that the guides extend from the door to accommodate coaction with said track.

13. The guide of claim 1, wherein said plastic material is linear high-density polyethylene.

14. The guide of claim 1, wherein said plastic material is an ultra-high molecular weight polyethylene.

15. The guide of claim 14, wherein said plastic material is black.

16. A finger door guide for the upper end of a door on an auto rack car adapted to be mounted in opposed relation to a second guide as a pair for coacting with opposite sides of a vertically extending steel track on the car to support the upper end of the door in an upright position and to guide the door along the track during opening and closing of the door, each said guide including a lower end mounted on the door and an upper end in aligned position with the track, and wear pad means fixed on said upper end for engaging said track, said wear pad means including a pad of high compressive strength, self-lubricating, wear-resistant plastic material, and said guides and pads being dimensioned and mounted on the door to provide a relatively close fit with the track and define a relatively tight tolerance in order to reduce vibration to the door and components of the door located below the guides.

17. The guide of claim 16, wherein the upper end of the guide is offset from the lower end of the guide.

18. The guide of claim 16, wherein the guide is a flat steel bar with the upper end offset from the lower end in a direction away from the track.

19. In combination with an auto rack car having a car body with upstanding side walls and a roof collectively defining opposed open ends, a plurality of levels in the car for receiving vehicles, door mounted on the car body at the opposed open ends which are movable between open and closed positions, hardware for mounting the doors and locking them in predetermined positions including lower and upper assemblies, each said upper assembly including a vertically extending steel track fixed to the car body, a pair of vertically extending door finger guides fixed to the door and coating with the track to support the door in an upright position and to guide the door during opening and closing operations, the improvement being in said door finger guides which comprise an elongated steel bar mounted at one end on the door and having the other end in alignment with said track, a wear pad fixed to the end of the bar aligned with said track, said wear pad including a bearing pad of high compressive strength, self-lubricating, wear-resistant plastic material having a low coefficient of friction, and said guides being dimensioned with said wear pads to define a relatively close fit relation with the track to reduce the tolerance with the track in order to materially reduce movement between the guides and track and thereby substantially reduce vibration to the door and hardware located below the guides.

20. The door finger guide of claim 19, wherein said bearing pads is directly bonded to the bar.

21. The door finger guide of claim 20, wherein the bearing pad covers the surface of the bar facing the track and the side edges of the bar.

22. The door finger guide of claim 19, wherein said bearing pads further include a steel base plate to which the bearing pad is molded and bonded, and means securing the base plate to the bar.

23. The door finger guide of claim 22, wherein said securing means includes welds between the base plate and bar.

24. The door finger guide of claim 19, wherein the bearing pad is of ultra-high molecular weight polyethylene.

25. The door finger guide of claim 19, wherein the bar is flat and rectangular in cross section.

26. The door finger guide of claim 25, wherein the bearing pad is molded and bonded directly to the bar and over the top and side edges of the bar.

27. The door finger guide of claim 19, wherein the bar is round in cross section.

28. The door finger guide of claim 19, wherein the end of the bar having the wear pad is offset from the end of the bar mounted on the door.

29. The combination of claim 19, which further includes an extension arm between the door and the door finger guides.

30. The combination of claim 19, wherein said bearing pad includes a U-shaped body having two upwardly extending legs interconnected at their lower ends, each leg including a bearing surface on the side facing the track and a socket on the opposite side for receiving the upper ends of said bars.

* * * * *

UNITED STATES PATENT AND TRADEMARK OFFICE

CERTIFICATE OF CORRECTION

PATENT NO. : 4,917,021

DATED : April 17, 1990

INVENTOR(S) : Michael K. Murphy

It is certified that error appears in the above-identified patent and that said Letters Patent is hereby corrected as shown below:

On the title page, item [57] ABSTRACT, line 1, change "an" to --on--; and under "References Cited" add the following:
--OTHER PUBLICATION
Holland Company Bulletin dated 2-1-8%--.

Col. 3, line 40, change "vie" to --view--.

Col. 12, lines 26-27, change "coating" to --coacting--.

Signed and Sealed this

Twenty-third Day of July, 1991

*Attest:*

*Attesting Officer*

HARRY F. MANBECK, JR.

*Commissioner of Patents and Trademarks*